United States Patent [19]

Dinwoodie et al.

[11] Patent Number: 5,002,836

[45] Date of Patent: Mar. 26, 1991

[54] FIBER-REINFORCED METAL MATRIX COMPOSITES

[75] Inventors: John Dinwoodie, Eastham; Michael D. Taylor, Great Barrow; Martyn H. Stacey, Northwich, all of England

[73] Assignee: Imperial Chemical Industries PLC, London, England

[21] Appl. No.: 435,722

[22] Filed: Nov. 14, 1989

Related U.S. Application Data

[63] Continuation of Ser. No. 196,765, May 17, 1988, abandoned, which is a continuation of Ser. No. 875,000, Jun. 16, 1986, abandoned.

[30] Foreign Application Priority Data

Jun. 21, 1985 [GB] United Kingdom ..... 8515766

[51] Int. Cl.[5] ..... C22C 1/09

[52] U.S. Cl. ..... 428/614; 428/924

[58] Field of Search ..... 428/608, 611, 614, 924

[56] References Cited

U.S. PATENT DOCUMENTS

| | | | |
|---|---|---|---|
| 3,167,427 | 1/1965 | Slayter | 75/201 |
| 3,218,697 | 11/1965 | Wainer | 29/420.5 |
| 3,970,136 | 7/1976 | Cannell et al. | 428/614 |
| 3,992,498 | 11/1976 | Morton | 264/63 |
| 4,036,599 | 7/1977 | Dhingra | 428/608 |
| 4,071,594 | 1/1978 | Pearson et al. | 264/63 |
| 4,094,690 | 6/1978 | Morton | 106/73.4 |
| 4,277,269 | 7/1981 | Sweeting | 65/2 |
| 4,450,207 | 5/1984 | Donomoto et al. | 428/614 |
| 4,457,979 | 7/1984 | Donomoto et al. | 428/614 |
| 4,515,866 | 5/1985 | Okamoto et al. | 428/614 |
| 4,544,610 | 10/1985 | Okamoto et al. | 428/614 |
| 4,590,132 | 5/1986 | Dohnomoto et al. | 428/614 |
| 4,595,638 | 6/1986 | Dohnomoto et al. | 428/614 |
| 4,601,956 | 7/1986 | Dohnomoto | 428/614 |
| 4,696,866 | 9/1987 | Tanaka et al. | 428/614 |
| 4,818,633 | 4/1989 | Dinwoodie et al. | 428/614 |

FOREIGN PATENT DOCUMENTS

| | | | |
|---|---|---|---|
| 0181403 | 5/1986 | European Pat. Off. . | |
| 3344687 | 10/1984 | Fed. Rep. of Germany . | |
| WO83/02291 | 7/1983 | Int'l Pat. Institute . | |
| 57-29543 | 2/1982 | Japan | 428/611 |
| 1470292 | 4/1977 | United Kingdom . | |
| 2080865 | 2/1982 | United Kingdom . | |

*Primary Examiner*—John J. Zimmerman

*Attorney, Agent, or Firm*—Cushman, Darby & Cushman

[57] ABSTRACT

A metal matrix composite comprises essentially-aligned, fine-diameter inorganic oxide fibers embedded in a metal matrix material such as a light metal, for example aluminium or magnesium or an alloy thereof. In a particular embodiment the fibers are nominally-continuous and preferably are of mean diameter below 5 microns. The composite can be made by liquid infiltration of a fiber preform comprising the fibres bound together with an inorganic or an organic binder or (in the case of short fibers) by extrusion of a mixture, for example a suspension, of the fibers and powdered metal matrix material.

10 Claims, No Drawings

FIBER-REINFORCED METAL MATRIX COMPOSITES

This is a continuation of application Ser. No. 07/196,765, filed 5/17/88 now abandoned which is a file wrapper continuation of application Ser. No. 06/875,000, filed 6/16/86 now abandoned.

This invention relates generally to the reinforcement of metals with inorganic fibers and more particularly to fiber-reinforced metal matrix composites comprising inorganic oxide fibers, notably alumina fibers, embedded as reinforcement in a metal matrix. The invention includes preforms made of inorganic oxide fibers and suitable for incorporation as reinforcement in a metal matrix and processes for the preparation of metal matrix composites and preforms.

Metal matrix composites (hereinafter abbreviated to MMCs) are known comprising inorganic oxide fibers such as polycrystalline alumina fibers in certain forms embedded as reinforcement in a matrix comprising a metal such as aluminium or magnesium or an alloy containing aluminium or magnesium as the major component. A fiber commonly used in such MMCs is alumina fiber in the form of short (e.g. up to 5 mm, fine-diameter (e.g. mean diameter 3 microns) fibers which are randomly oriented at least in a plane perpendicular to the thickness direction of the composite material MMCs of this type containing alumina fibers in alloys have begun to be used in industry in a number of applications, notably in pistons for internal combustion engines wherein the ring-land areas and/or crown regions are reinforced with the alumina fibers.

MMCs containing aligned, continuous alumina fibers have also been proposed for use in applications where uni-directional strength is required, for example in the reinforcement of connection rods for internal combustion engines. In MMCs of this type, the alumina fibers are of relatively large diameter, for example at least 8 and usually at least 10 microns diameter, and comprise a high proportion, for example from 60 to 100%, of alpha alumina. Such fibers exhibit high strength but poor flexibility.

Hitherto, aligned fine-diameter (typically below 10 microns and preferably below 5 microns mean diameter) fibers, which may be short (typically below 5 cms) or nominally continuous (typically length greater than 0.5 metre and preferably several metres), and MMCs containing them have not been produced. The present invention is concerned with MMCs and preforms for MMCs comprising aligned, fine-diameter fibers.

According to the invention there is provided a metal matrix composite comprising essentially-aligned inorganic oxide fibers of mean diameter below 10 microns and preferably below 5 microns embedded in a metal matrix material.

The inorganic oxide fibers are preferably nominally-continuous fibers.

Also according to the invention there is provided a preform suitable for incorporation in a metal matrix material to produce a metal matrix composite in accordance with the immediately-preceding paragraph and comprising essentially-aligned inorganic oxide fibers of mean diameter below 10 microns bound together with a binder which Preferably is or contains an inorganic binder.

The inorganic oxide fibers may if desired be used in admixture with other types of fibers and/or with non-fibrous particulate materials, for example silicon carbide whiskers, aluminosilicate fibers and particulate alumina, zirconia or silicon carbide, the proportion of other material(s) in such mixtures typically being from about 40% to about 80% of the fibers.

The volume fraction of the fibers in the MMC (and in the preform) may vary within wide limits depending upon the required duty of the MMC and hence on the reinforcement. As a guide, volume fractions of fibers from about 10% to 60% or even higher can be achieved. The use of essentially-aligned fibers in accordance with the invention has the advantage of enabling high volume fractions of fibers, for example greater than 35%, to be achieved without significant breakage of the fibers.

Incorporation of large amounts of fibers in metal matrix composites involves packing the fibers together to obtain high volume fractions of the fibers in the composites. Inorganic oxide fibers are hard and quite brittle and compression of a randomly-oriented mat or blanket of the fibers results in extensive breakage of the fibers. Orientation or alignment of the fibers results in less breakage of the fibers when compression is applied to obtain high volume fractions of fibers.

The inorganic oxide fibers may be very short fibers, for example chopped fibers, of length from a critical minimum length of a few, say 5 and typically about 20,microns up to a few hundred microns, say 500 microns, or they may be relatively long fibers of length several cms or even several metres (depending of course upon the length of the MMC being produced); in the case of small MMCs the fibers or most of them may be continuous throughout the length of the MMC. The length of the fibers is important in determining the method by which the MMC is produced. Short fibers such as chopped fibers are not generally available in aligned-fiber form and it is necessary when employing such fibers to use a fabrication technique which results in alignment of the fibers, a particularly suitable technique being an extrusion technique in which the fibers are mixed with a binder (to form a preform) or with a powdered metal matrix material (to form an MMC directly) and are extruded through die under conditions of shear whereby the fibers are aligned in the extrudate. On the other hand long fibers cannot be aligned during the MMC or preform fabrication technique and should be pre-aligned, for example in the form of a mat or blanket of essentially-aligned fibers.

Essentially-aligned fiber products, i.e. product forms such as a mat or blanket in which the fibers as spun are essentially aligned, can be compressed to increase the volume fraction of fibers therein to greater than 25% without undue breakage of the fibers and in particular with only a very low degree of fiber breakage compared with the breakage resulting from compression to the same volume fraction of fibers of a product made of randomly oriented fibers of the same diameter In a particular embodiment of the invention the product, which preferably comprises nominally-continuous fibers is compressible to increase the volume fraction of fibers therein to about 50% or greater without significant breakage (i.e. reduction in length) of the fibers. The pressure applied to compress the fibers may be from 5 to 1000 MPa without causing extensive breakage of the fibers. By comparison, compression of a randomly-oriented mat of fibers of the same diameter to a volume fraction of fibers of 12 to 15% results in extensive breakage of the fibers.

Breakage of fibers during compression of the product results in a decrease in the tensile strength of the product in the general direction of alignment of the fibers. Excessive breakage of fibers is denoted by an abrupt fall, i.e. a fall to below 50%, in the specific tensile strength (=breaking force/mass of sample) of the product. By compression "without significant breakage" of the fibers we mean compression without causing a fall to below 50% in the specific tensile strength of the product.

The degree of compression at which significant breakage of the fibers occurs, as represented by an abrupt fall in specific tensile strength of the product, is roughly determined by compressing strips of the product (each strip of the same length and approximately the same breadth and weight) to different volume fractions of fibers, determining the specific tensile strength of each compressed strip and noting the degrees of compression between which an abrupt fall is observed in the specific strength of the compressed samples. By way of illustration strips of an essentially aligned-fiber product according to the invention wherein the volume fraction of fibers was 10% and of size 50 mm×3 mm (with the length direction in the general direction of alignment of the fibers) were compressed to thicknesses corresponding to volume fractions of fibers of 20, 30, 35, 40 and 45% in a 50 mm×3 mm channel with matching plunger. The tensile strength of each compressed strip was determined and the specific tensile strength of the compressed strip was calculated. In this experiment the specific tensile strength of the strips was found to be ±20% the same for the strips compressed to volume fractions of 20, 30 and 35% whilst the specific tensile strength of the strip compressed to 40% volume fraction had fallen to only about 5% of the strength of the first three compressed strips. The degree of compression at which the fibers suffered significant breakage accordingly was compression to between 35 and 40% volume fraction of fibers.

As a rough guide to the compressibility of the fiber product, the abrupt fall in the specific tensile strength of the product indicating excessive breakage of the fibers can be detected by pulling the product sample between the fingers; the undamaged product resists pulling apart whilst a damaged product pulls apart easily. Using this simple test an experienced operator can determine reasonably accurately the point at which excessive damage of the fibers occurs.

The fibers in the MMC and the preform are essentially aligned and a high degree of fiber orientation in the MMC and the preform is achieved. If desired, substantially all of the fibers in the MMC or the preform can be oriented in the same direction of alignment so as to impart one-direction strength to the article. Alternatively, a multi-layer fiber reinforcement can be employed in which the fibers in a particular layer are essentially aligned but in which the fibers in different layers are cross-plied, i.e. oriented in different directions, so as to impart multi-direction strength to the article. It is to be understood that MMCs and preforms comprising a multi-layer fiber reinforcement wherein the fibers in each layer are aligned but wherein the direction of orientation of the fibers in different layers is different are nevertheless within the scope of the invention.

The present invention resides in modification of the stiffness/modulus and high temperature performance of metals, especially lightweight metals such as aluminium and magnesium and :heir alloys, by incorporating therein fibers of high strength and modulus. The volume fraction of fibers in the composite material may be for example up to 60% or even higher, typically from 10% to 50%, of the composite. The composite may contain, for example, from 0.1 to 2.5 g/ml of alumina fibers, typically from 0.2 to 2.0 g/ml, or up to 3 g/ml of zirconia fibers. The fiber content of the composite may vary throughout the thickness of the composite being high for example in the outer face (in use) of the composite and lower in the opposite face. Changes in fiber content may be uniform or stepwise. An embodiment of the invention resides in an MMC wherein the fiber content varies stepwise and is provided by a laminate of MMCs of different fiber contents, the individual MMCs being separated if desired in an integral laminate by a layer of the metal e.g. a sheet cf aluminium or magnesium. The composite may have a backing sheet of a suitable textile fabric, for example a sheet of Kevlar fabric.

The reinforcement in the MMCs may be an essentially-aligned fiber product comprising inorganic oxide fibers of average diameter not greater than 10 microns and preferably not greater than 5 microns. By the term "essentially-aligned-fiber product" is meant a product form in which the fibers extend in the same general direction but may not in the case of long fibers be truly parallel over their entire length so that a degree of overlap of fibers is possible and any particular fiber may extend over part of or even its entire length at an angle, e.g. up to 30°, or even higher with respect to the general direction of alignment of the fibers. In such a product the overall impression is of fibers which are parallel but in fact a slight degree of overlap and intertwining of fibers may be desirable in order to confer lateral stability to the product to enable it to be handled without undue separation of the fibers. We prefer that at least 90% of the fibers are essentially parallel.

In a particular embodiment of the aligned-fiber product, the inorganic oxide fibers are "nominally continuous" by which term is meant that the individual fibers may not be truly continuous in the sense of having infinite length or of extending the entire length of the product but each fiber has appreciable length, e.g. at least 0.5 metre and usually several metres, such that the overall impression in the product is of continuous fibers. Thus free ends of fibers may appear in the product, representing an interruption in fiber continuity, but in general the number of free ends in any square cm of the product will be relatively low and the proportion of interruPted fibers in a square cm will be no greater than about 1 in 100.

A typical fiber reinforcement for use in making MMCs according to the invention and comprising nominally-continuous fibers is a mat or blanket of thickness a few mms. In a product of this thickness the number of free ends of fiber in a square cm of the product may be up to about 2500; this compares with about 50,000 free ends in a product of similar mass made of short (up to 5 cms) staple fibers of the same diameter. The product made of nominally continuous fibers is thus very different in appearance and properties from a product made of short, staple fibers.

The fibers in the fiber reinforcement are polycrystalline metal oxide fibers such as alumina and zirconia fibers and preferably are alumina fibers. In this case the alumina fibers may comprise alpha-alumina or a transition phase of alumina, notably gamma- or delta-alumina, depending largely upon any heat treatment to which the fibers have been subjected. Typically the fibers will comprise wholly a transition alumina or a minor proportion of alpha-alumina embedded in a matrix of a transition alumina such as eta-, gamma- or delta-alumina. We prefer fibers comprising zero or a low alpha-alumina content and in particular an alpha-alumina content of below 20% and especially below 10% by weight. In general the greater the alpha-alumina content of the fiber, the lower is its tensile strength and the lower is its flexibility. The preferred fibers of the invention exhibit acceptable tensile strengths and have a high flexibility. In a particular embodiment of the invention, the fibers have a tensile strength greater than 1750 MPa and a modulus greater than 200 GPa.

In the case of alumina fibers, the density of the fibers is largely dependent upon the heat treatment to which the fibers have been subjected. After spinning and at least partial drying, the gel fibers are heated in steam at a temperature of from 200° C. to about 600° C. to decompose the metal oxide precursor and then are further heated to sinter the resulting metal oxide fibers. Sintering temperatures of 1000° C. or higher may be employed. After the steam treatment the fibers are highly porous and high porosity is retained during sintering up to, for example 90°–950° C. However, after sintering at for example, 1100° C. or higher the fibers have little porosity. Thus by controlling the sintering temperature, low density fibers of high porosity or high density fibers of low porosity may be obtained. Typical apparent densities for low density and high density fibers are 1.75 g/ml and 3.3 g/ml; fibers of any desired density within this range can be obtained by careful control of the heat treatment to which the fibers are subjected.

We have observed that the modulus of alumina fibers does not appear to be greatly affected by the heat treatment program above 800° C. to which the fibers have been subjected and does not vary greatly in accordance with the apparent density of the fibers. For instance, over the range of apparent fiber densities of 2 g/ml to 3.3 g/ml, modulus has typically been observed to change from about 150–200 GPa to about 200–250 Gpa. Thus the ratio of fiber modulus to fiber density (=specific modulus) is generally greatest in respect of low density fibers.

Aligned and nominally-continuous fiber products can be produced by a blow-spinning technique or a centrifugal spinning technique, in both cases a spinning formulation being formed into a multiplicity of fiber precursor streams which are dried at least partially in flight to yield gel fibers which are then collected on a suitable device such as a wind-up drum rotating at high speed. The speed of rotation of the wind-up drum will depend upon the diameter of the drum and is matched to the speed of spinning of the fibers so that undue tension is not applied to the weak gel fibers. As a guide only, a wind-up drum speed of 1500 rpm is fairly typical for a drum of diameter 15 cms. In practice it may be desirable to wind the wind-up drum slightly faster than the speed of extrusion of the fibers so that the fibers are subjected to slight tension which serves to draw down the fibers to the desired diameter and to keep the fibers straight. Of course, the applied tension should not be sufficient to break the majority of the fibers.

As stated hereinbefore, the fibers may not be truly continuous and generally are of length a few meters. The minimum fiber length in the case of collection on a wind-up drum is approximately equal to the circumference of the wind-up drum since fibers which are shorter than this tend to be flung off the rotating drum. Because the fibers are not of infinite length it is important that a multiplicity of fibers be spun simultaneously so that the resulting collection of fibers pass through the apparatus in a bundle or sheet whereby free ends of fibers are carried along by the bundle or sheet of fibers which gives an overall impression of fiber-continuity.

The spinning formulation may be any of those known in the art for producing polycrystalline metal oxide fibers and preferably is a spinning solution free or essentially free from suspended solid particles of size greater than 10, preferably of size greater than 5, microns. The rheology characteristics of the spinning formulation can be readily adjusted to result in long fibers rather than short fibers, for example by use of spinning aids such as organic polymers or by varying the concentration of fiber-forming components in the formulation.

The fiber reinforcement can be a sheet or mat comprising essentially-aligned and nominally-continuous fibers exhibiting lateral cohesion as a result of entanglement of some of the fibers. A small degree of non-alignment of the fibers in the product has the advantage of conferring lateral stability on the product to enable it to be handled satisfactorily. A preferred product possesses a degree of lateral cohesion such that significant separation of the fibers is resisted under normal product handling conditions. Preferably the lateral cohesion in the product is such that the product exhibits a tensile strength of at least 25,000 Pa in a direction perpendicular to the general direction of alignment of the fibers. The lateral strength of the product will depend to some extent upon the diameter of the fibers since given the same degree of entanglement, fatter fibers will produce a greater lateral strength than will thinner fibers; in fact fatter fibers tend to be less entangled than thinner fibers so that in practice fatter fibers result in lower lateral strengths in the product.

A typical product of this type is a sheet or mat of thickness a few, say 2–5 mms, width several cms and length a metre or more, obtained by collecting the fibers on a wind-up drum and cutting the collected fibers parallel to the axis of the wind-up drum (the length and width of the sheet or mat thus being determined by the dimensions of the wind-up drum). Other product forms such as yarns, rovings, tapes and ribbons can be obtained either from the product collected on a wind-up drum or directly by using a suitable fiber-collection technique. In the case of a product collected on a wind-up drum, the product can be cut in the general direction of alignment of the fibers to provide tapes or ribbons which can be drawn off from the drum and converted if desired into yarns or rovings. A fiber prOduct in the form of yarns, rovings, tapes or ribbons can be converted into woven products using suitable weaving techniques.

Any metal may be employed as the matrix material which melts at a temperature below about 1200° C. However a particular advantage of the invention is improvement in the performance of light metals so that they may be used instead of heavy metals and it is with reinforcement of light metals that the invention is particularly concerned. Examples of suitable light metals are aluminium, magnesium and titanium and alloys of these metals containing the named metal as the major component, for example representing greater than 80% or 90% by weight of the alloy.

As is described hereinbefore, the fibers may be porous, low density materials or high density materials of low or zero porosity depending upon the heat treatment to which the fibers have been subjected. Since the fibers can constitute 50% or more by volume of the MMC the density of the fibers can significantly affect the density of the MMC. Thus, for example, a magnesium alloy of density about 1.9 g/ml reinforced with 50% volume fraction of fibers of density 3.3 g/ml will provide an MMC of density about 2.6 g/ml, i.e. denser than the alloy itself; conversely an aluminium alloy of density 2.8 g/ml reinforced with 50% volume fraction of fibers of density 2.1 g/ml will provide an MMC of density 2.45 g/ml, i.e. less dense than the alloy itself.

The present invention thus enables MMCs to be produced having a predetermined density within a wide range. Aluminium and magnesium and their alloys typically have a density in the range 1.7 to 2.8 g/ml and since the density of the fibers can vary from about 1.75 to 3.3 g/ml, MMCs of density 1.9 to about 3.0 g/ml can readily be produced. An especially light metal or alloy reinforced with an especially light fiber is a preferred feature of the invention, in particular magnesium or a magnesium alloy of density less than 2.0 g/ml reinforced with a fiber (notably an alumina fiber) of density less than or about 2.0 g/ml to provide an MMC of density less than 2.0 g/ml.

If desired the surface of the fibers may be modified in order to improve wettability of the fibers by the metal matrix material and other fiber characteristics. For example the fiber surface may be modified by coating the fibers or incorporating a modifying agent in the fibers to improve their chemical resistance or control interfacial bonding and hence properties such as fracture toughness . Alternatively, the metal matrix material may be modified by incorporating therein elements which enhance the wettability of the inorganic oxide fibers by the matrix material, for example tin, cadmium, antimony, barium, bismuth, calcium, strontium or indium.

For making the MMCs according to the invention, whether using short fibers or long fibers, we prefer a preform/liquid metal infiltration technique in which the fibers are first assembled into a preform wherein the fibers are bound together by a binder, usually one consisting of or containing an inorganic binder such as silica. This binder may be fugitive, i.e. displaced by the molten metal with which the preform is infiltrated. It is possible to incorporate elements in the binder which enhance the wettability of the fibers by the matrix material during infiltration of the preform.

Whilst we prefer to employ a preform in which the fibers are bound together with a binder, especially an inorganic binder, so as the constrain the fibers against movement during infiltration of the preform with liquid metal, it is possible to employ an assembly of fibers in which the fibers are constrained against movement by means other than an inorganic binder. One way of doing this is to pack the fibers into a tube or mould. A convenient way of packing a tube or mould with short fibers is to form a preform using a wholly organic binder, locate the preform in the tube or mould and then burn out the organic binder leaving the closely packed but non-bound fibers in the tube. Alignment of the short fibers can be achieved by producing the preform using an extrusion technique. Aligned long, continuous or nominally-continuous fibers can be packed directly into a mould having moving parts and compressed to the required volume fraction fibers on closure of the mould.

In the preferred preform/infiltration technique, the molten metal may be squeezed into the preform under pressure or it may be sucked into the preform under vacuum. We have observed that application of pressure or vacuum to facilitate infiltration of the preform with a liquid metal matrix material obviates any problems of wetting of the fibers by the matrix material. Infiltration of the metal into the preform may be effected in the thickness direction of the preform or at an angle, preferably at 90°, to the thickness direction of the preform and along the fibers. In the preform the aligned fibers will usually be orientated in a plane perpendicular to the thickness direction of the preform. Infiltration of the metal into the preform in the thickness direction, i.e. across the fibers, may cause separation of the fibers and/or compression of the preform and loss of reinforcement properties in the MMC; infiltration of the metal into the preform along the fiber length in the direction of alignment/orientation of the fibers reduces the tendency of the fibers to separate and/or the tendency to compress the preform and may lead to enhanced reinforcement of the metal by the fibers.

Infiltration of the molten metal into the preform may in the case of aluminium or aluminium alloys be carried out under an atmosphere containing oxygen, e.g. ambient air, but when using certain metal matrix materials such as, for example, magnesium and magnesium alloys, oxygen is preferably excluded from the atmosphere above the molten metal. Molten magnesium or an alloy thereof is typically handled under an inert atmosphere during infiltration thereof into the preform, for example an atmosphere comprising a small amount (e.g. 2%) of sulphur hexafluoride in carbon dioxide in order to avoid oxidation of the (molten) metal.

An alternative method of making MMCs which is especially useful when using short, non-aligned fibers, is by extrusion of a mixture of the fibers and the metal matrix material. If desired, the fibers may be suspended in the molten metal and the suspension extruded through a die but generally the fibers are mixed with the powdered metal, conveniently at room temperature, and the mixture is extruded at an elevated temperature for example 300°-350° C. The mixture and/or the extrusion die may be preheated. We prefer to wetmix the fibers and the metal powder and in particular to add a liquid to the mixture in an amount just sufficient to wet-out the fibers and so prevent "balling" during mixing and ensure that a shearing action is imparted to the mixture rather than a rolling action. After mixing and prior to extrusion of the mixture, the liquid is preferably removed and this can be effected by de-gassing under vacuum or, if the liquid is sufficiently volatile, simply by allowing it to evaporate from the mixture. Any liquid can be used which wets the fibers and the powder and for this reason we prefer to use a non-aqueous liquid. Convenient liquids are industrial methylated spirits and isopropanol.

In a variation of the extrusion technique for making MMCs, the mixture of fibers and matrix metal which is extruded is a billet which itself is in the form of an MMC; thus one MMC is extruded to yield another MMC. The billet, in which the fibers (in the case of short fibers at least) may be aligned or randomly orientated can be Produced by any convenient technique, for example by hot pressing a fiber/powder mixture or by liquid metal infiltration of a fiber bundle or preform. The billet may itself be produced by an extrusion technique or by liquid metal infiltration of a preform made by an extrusion technique.

Preparation of preforms for infiltration by molten metal matrix materials can be effected by a wide variety of techniques, including for example pultrusion, filament-winding, injection moulding, compression moulding, spraying or dipping and, in the case of short fibers, extrusion. Such techniques are well known in the production of fiber-reinforced resin composites and it will be appreciated that use of mobile binder(s) or a suspension of binder(s) instead of a resin in the known techniques will yield a preform. Other techniques for producing preforms include hand lay-up techniques and powder-compaction techniques. In hand lay-up techniques thin samples of fibrous materials, e.g. woven materials, are impregnated with a suspension of binder(s) and multiple layers of the wet, impregnated samples are assembled by hand and the assembly is then compressed in a die or mould to yield an integral preform. In powder-compaction techniques, layers of fibrous materials and binder(s) in powder form are assembled, e.g. by hand lay-up, and the assembly is then compressed in a die or mould at a temperature sufficient to melt the powdered binder(s) to form an integral preform. The preferred method for making aligned-fiber preforms from short fibers is by an extrusion technique.

The binder used to form the preform may be an inorganic binder or an organic binder or a mixture thereof. Any inorganic or organic binder may be used which (when dried) binds the fibers together to an extent such that the preform can be handled without damage. Examples of suitable inorganic binders are silica, alumina, zirconia and magnesia and mixtures thereof. Examples of suitable organic binders are carbohydrates, proteins, gums, latex materials and solutions or suspensions of polymers.

The amount of binder(s) may vary within a wide range of up to about 50% by weight of the fibers in the preform but typically will be within the range of 10% to 30% by weight of the fibers. By way of a guide, a suitable mixed binder comprises from 1 to 20%, say about 5%, by weight of an inorganic binder such as silica and from 1 to 10%, say about 5%, by weight of an organic binder such as starch. In the case where the binder is applied in the form of a suspension in a carrier liquid, an aqueous carrier liquid is preferred.

As is discussed hereinbefore, the MMCs of the invention can be made by infiltration of a preform or by extrusion. Alternatively, any of the other techniques described for making preforms may be adapted for making MMCs directly by employing a metal matrix material instead of a binder or mixture of binders. Additional techniques for making MMCs include chemical coating, vapour deposition, plasma spraying, electrochemical plating, diffusion bonding, hot rolling, isostatic pressing, explosive welding and centrifugal casting.

In making MMCs, care needs to be exercised to prevent the production of voids in the MMC. In general, the voidage in the MMC should be below 10% and preferably is below 5%; ideally the MMC is totally free of voids. The application of heat and high pressure to the MMC during its production will usually be sufficient to ensure the absence of voids in the structure of the MMC.

The MMCs according to the invention may be used in any of the applications where fiber-reinforced metals are employed, for example in the motor industry and for impact resistance applications. The MMC may, if desired, be laminated with other MMCs or other substrates such as sheets of metal.

The invention is illustrated by the following Examples in which, unless otherwise indicated in examples relating to extrusion techniques, the fiber reinforcement was produced as follows:

PREPARATION OF A GEL SPINNING SOLUTION 0.1 gm of thiourea was dissolved in 600 gms of commercial aluminium chlorhydrate solution (Locron L available from Hoechst AG). The solution was stirred with a propeller stirrer and 6.5 gms of polyethylene oxide (Union Carbide Polyox WSR-N-750) were added; the polymer dissolved over a period of 2 hours. At this stage the solution viscosity was approximately 1 poise. 160 gms of aluminium chlorhydrate powder (Hoechst Locron P) were then added to the solution; the powder dissolved after a further 2 hours stirring. 35 gms of a siloxane surfactant, Dow DC 193, were then added. The solution was filtered through a glass fiber filter (Whatman 6FB) rated nominally between 1 and 1.5 microns.

The solution viscosity, measured on a low shear Ubbelhode capillary viscometer was 18 poise.

FORMATION OF FIBERS

The solution was extruded through a row of holes on either side of which were slits through which air was directed to converge on the emerging extrudate. The air flowed at 60 m/sec and was humidified to 85% relative humidity at 25° C. Further streams of heated dry air at 60° C. flowed outside the humidified air streams. Long, (nominally continuous) gel fibers were formed and these were fed with the co-flowing air streams into a converging duct at the base of which the mixture impinged at a gas velocity of 14 m/sec on a rotor coated with fine Carborundum paper and rotating at 12 m/sec peripheral velocity. A blanket of essentially aligned fibers accumulated on the rotor.

After 30 minutes, the rotor was withdrawn from the base of the converging duct, stopped and the aligned-fiber blanket was cut parallel to the axis of the rotor and removed from the rotor. At this stage the gel fibers contained 43% by weight of refractory material with silica constituting 4.1%, by weight of the refractory material. The median gel fiber diameter was 5 microns.

The "as spun", gel fiber blanket was dried for 30 minutes in an oven at 150° C. and then was immediately transferred to a second oven purged with steam at 300° C. and 1 atmosphere pressure. The purge steam temperature was raised to 600° C. over a period of 45 minutes, whereupon the oven was purged with air and the temperature was then increased gradually to 900° C. over a period of 45 minutes. At this stage, the fibers were white and porous. The main crystalline phase was eta-alumina, the porosity 40% by volume and the surface area 140 m2/g. The median diameter of the fibers was 3.6 microns.

The fiber product, where indicated, was then heated in air for 15 minutes at 1300° C. A refractory fiber of median diameter 3 microns was obtained. The principle alumina phase in the fiber was delta-alumina in the form of small crystallites together with 3% by weight of alpha-alumina. The fiber porosity was 10%.

EXAMPLE 1

A circular preform of size 100 mm diameter and 15 mm thickness was prepared from polycrystalline alumina fibers by a hand lay-up technique.

Circular samples (100 mm diameter) were cut from a sheet or mat of essentially-aligned, nominally-continuous, polycrystalline alumina fibers fired at 1300° C. The density, tensile strength and modulus of the fibers were 3.3 g/ml, 2,000 MPa and 300 GPa. The mat had a lateral strength cf 42,500N,/m$^2$.

The samples of fiber mat were sprayed with an aqueous silica sol in an amount providing a pick-up of silica (dry weight) of about 5% by weight of the fibers. Immediately following the silica application, the sample were sprayed with an aqueous solution of starch and a retention aid available under the trade name "Percol" in an amount to provide a pick-up (dry weight) of 5% starch and 2% "Percol" by weight of the fibers. The starch/'-'Percol" solution serves to flocculate the silica sol onto the fibers and retain the silica on the fibers.

Impregnated circular samples of the fibers were laid-up by hand in a cylindrical mould such that the fibers in the several layers were aligned in the same direction and the assembly was compressed to a predetermined density corresponding to a predetermined volume fraction of fiber. The assembly was dried in air at approximately 110° C. for about 4 hours and then was fired at 1200° C. for 20 minutes to consolidate the assembly and burn out any organic materials. Using this technique, preforms were produced of fiber volume fractions 0.2 and 0.5 which were designated "Preform A" and "Preform B" respectively.

Two further preforms, designated "Preform C" and "Preform D" of fiber volume fraction 0.2 and 0.5 respectively were produced by the above technique from a mat of essentially-aligned, nominally-continuous polycrystalline alumina fibers fired at 900° C. The density, strength and modulus of the fibers were 2.1 g/ml, 2100 MPa and 210 GPa. The mat had a lateral strength of 35,000N/m$^2$. In making Preforms C and D the temperature at which the assembly of fibers was fired was 900° C. instead of 1200° C.

MMCs were made from the preforms as follows. Each of the preforms A and B was placed in a die preheated to 500° C. and molten metal at a temperature of 840° C. was poured onto the preform. Each of preforms C and D was preheated at 840° C. in a die and molten metal at 840° C. was poured onto the preform.. The metal was an aluminium alloy available as Al 6061 and of approximate percentage composition 97.95 Al, 1.0 Mg, 0.6 Si, 0.25 Cu, 0.25 Cr.

The molten metal was forced into the preforms under a pressure of 30 MPa applied by a hydraulic ram for a period of 1 minute. The resulting billet (MMC) was demoulded and given a T6 treatment (520° C. for 8 hours solution treatment and 220° C. for 24 hours precipitation treatment). The resulting tempered billet was cooled to room temperature and its properties were measured. The results are shown in Table 1 below.

TABLE 1

| Preform | Density (g/ml) | Ultimate Tensile Strength (MPa) | Modulus (GPa) | *Relative Specific Strength | *Relative Specific Modulus |
|---|---|---|---|---|---|
| A | 2.82 | 480 | 116 | 1.48 | 1.58 |
| B | 3.0 | 780 | 185 | 2.26 | 2.31 |
| C | 2.58 | 434 | 97 | 1.26 | 1.42 |
| D | 2.40 | 665 | 138 | 2.48 | 2.20 |
| Fibers (A/B) | 3.3 | 2000 | 300 | | |
| Fibers (C/D) | 2.1 | 2100 | 206 | | |
| Alloy | 2.7 | 310 | 70 | | |

*Relative to a value of 1.0 for unreinforced alloy.

EXAMPLE 2

Four preforms, designated "Preforms A-D", were prepared as described in Example 1.

MMCs were made from the preforms by the squeeze infiltration technique described in Example 1 but using a magnesium alloy, Mg-ZE63 of approximate %age composition 90 Mg, 5.8 Zn, 2.5 rare earth metals and 0.7 Zr, instead of an aluminium alloy. The molten magnesium alloy under a blanket of 2% $SF_6$ in carbon dioxide and at a temperature of 800° C. was poured onto the preform (preheated at 500° C. in the case of preforms A and B and 800° C. in the case of preforms C and D) and squeezed into the preform under a pressure of 30 MPa applied for 1 minute.

The resulting MMC was demoulded and cooled and its properties were determined and are shown in Table 2.

TABLE 2

| Preform | Density (g/ml) | Ultimate Tensile Strength (MPa) | Modulus (GPa) | *Relative Specific Strength | *Relative Specific Modulus |
|---|---|---|---|---|---|
| A | 2.16 | 395 | 96 | 1.18 | 1.84 |
| B | 2.60 | 727 | 173 | 1.81 | 2.76 |
| C | 1.92 | 278 | 77 | 1.08 | 1.66 |
| D | 1.99 | 568 | 126 | 1.79 | 2.63 |
| Fibers (A/B) | 3.3 | 2000 | 300 | | |
| Fibers (C/D) | 2.1 | 2100 | 206 | | |
| Alloy | 1.87 | 239 | 45 | | |

*Relative to unreinforced alloy value = 1.0.

EXAMPLES 3 AND 4

Fiber tows of length approximately 5–7 cm produced from a blanket of essentially-aligned alumina fibers of mean diameter 3 microns which had been heat-treated in steam and then heated at 950° C. were weighed and laid in layers in the lower half of a mould comprising two half-round members which form a cylinder of diameter 1–1.5 cm when the mould is closed. The mould was closed to compress the fibers, both halves of the mould moving to reduce uneven pressures and dead zones. The mould is open-ended, thereby providing access to the ends of the compressed bundle of fibers. The volume fraction of fibers in the compressed bundle was 0.57 (Example 3).

The mould was turned through 90° so that the fiber bundle was vertical and its lower end was closed and connected to an Edwards 5 single stage vacuum pump. Using a funnel, a liquid methyl methacrylate resin (Modar 835) was poured into the top of the mould whilst vacuum was applied to the bottom of the mould to suck the resin into the mould to impregnate the bundle of fibers. The connection to vacuum was removed and the resin was left to cure for 2 hours at room temperature. The mould was then opened and the resinbonded fiber preform was removed and finished on a lathe.

The finished preform was fitted into a mild steel tube which was then heated to about 700° C. to burn out the resin and allow the aligned fibers to relax within the tube. The tube was then placed in a squeeze-infiltration machine and infiltrated at 600° C. with a molten aluminium alloy (6061) of approximate composition Al 97.95% Mg 1%:Si 0.6%:Cr 0.25%:Cu 0.25%. The tube was then allowed to cool; the composite was not aged.

In a further experiment (Example 4), a rod-like metal matrix composite was prepared as described above except that the volume fraction of alumina fibers was 0.56 instead of 0.57.

The modulus of the metal matrix composites were:

Ex.3 Modulus—160 GPa

Ex.4 Modulus—154 GPa.

EXAMPLE 5

A rod-like metal matrix composite was prepared as described in Example 3 except that the volume fraction of alumina fibers was 0.45 and the fibers were taken from a blanket which had been heated in air at 1300 ° C. instead of 950° C.

The modulus of the composite was 151 GPa.

EXAMPLES 6–15

Rod-like metal matrix composites were prepared as described in Example 3 containing the fiber volume fractions shown below together with the properties of the composite.

| Exp No | V. F. fiber | Fiber firing temp (°C.) | Metal Matrix |
|---|---|---|---|
| 6 | 0.60 | 950 | 6061 |
| 7 | 0.46 | 950 | " |
| 8 | 0.53 | 950 | " |
| 9 | 0.49 | 950 | " |
| 10 | 0.43 | 1300 | " |
| 11 | 0.31 | 1300 | " |
| 12 | 0.35 | 950 | " |
| 13 | 0.40 | 950 | " |
| 14 | 0.57 | 950 | Mg |
| 15 | 0.56 | 950 | Mg |

The density of the composites in Examples 14 and 15 (Mg matrix) was less than 2.0 g/ml. In all Examples the strength and modulus of the composites were as predicted from the corresponding properties of the fibers and the matrix metal.

EXAMPLES 16–18

These Examples illustrate the preparation of metal matrix composites from chopped alumina fibers of mean diameter 3 microns and an alloy (Lital) of approximate percentage composition Al 95.55:Li 2.5: Mg 0.6:Zr 0.12.

Chopped alumina fibers of nominal length 64 microns were blended at room temperature with powdered alloy in a Kenwood food mixer. Isopropanol was added to the mixture in an amount just sufficient to prevent the mixture from "balling" and thus ensure that a shearing action rather than rolling was imparted to the mixture. The isoproPanol was allowed to evaporate from the mixture which was then packed into an aluminium alloy "can" of diameter 7 cm and length 22.5 cm and wall thickness 10 mm. A lid was fitted to the "can" which then was heated at 300° C. for 1.25 hours. The "can" was then extruded at 350° C. through a preheated round die fitted with a 120° tapered ring to provide an extrusion ratio of 10:1.

Three extruded metal matrix composites (Examples 16, 17 and 18) were produced in this way, containing volume fractions of alumina fibers of 0.12, 0.2 and 0.2 respectively. In the third experiment (Example 18) the extrusion ratio was 7:1 rather than 10:1.

In each Example, the modulus of the metal matrix composite, which was not subjected to a subsequent solution treatment, was slightly greater than 100 GPa indicating the drawing of about 200 GPa from the alumina fibers. In each composite at least 95% of the alumina fibers were aligned within 5° of the direction of extrusion of the composite.

EXAMPLE 19

Using the procedure described in Example 16, a metal matrix composite was prepared containing a volume fraction of aligned, chopped yttria-stabilized zirconia fibers and titanium metal fines. The metal showed no signs of oxide attack and had not become embrittled.

EXAMPLES 20–22

These Examples illustrate the preparation of bound alumina fiber preforms comprising essentially aligned fibers and suitable for use in the manufacture of metal matrix composites using, for example, the procedure described in ExamPle 14.

A blend of fibers and binders was prepared as follows in the chamber of an extrusion machine and under vacuum. Approximately one half of the total of chopped alumina fibers ("Saffil" RF grade - mean diameter 3 microns, nominal chopped length 160 microns) was mixed with powdered polyvinylalcohol and then silica sol and about one half of the chosen volume of water were added and mixed in. The silica sol was 1030 from Nalfloc Ltd containing 30% by weight silica. Cellulose pulp was then added (Examples 21 and 22), followed by the remainder of the water and finally by the remainder of the chopped alumina fibers. The total mixing time was about 60 minutes to produce a blend of uniform consistency.

The vacuum in the mixing chamber was reduced to 720 mm Hg and the blend of fibers and binders was extruded through a round die. The resulting extrudate was fired at 600° C. to burn off the polyvinylalcohol.

Preforms were prepared to the following formulations:

EXAMPLE 20

| | Parts by weight |
|---|---|
| chopped alumina fibers | 100 |
| polyvinylalcohol | 10 |
| silica sol | 10 |
| water | 25 |

After firing, the preform had a density of 1.6 gm/ml, and the volume fraction of fibers was 0.48.

EXAMPLE 21

| | Parts by weight |
|---|---|
| chopped alumina fibers | 100 |
| polyvinylalcohol | 20 |
| silica sol | 19 |
| cellulose pulp | 40 |

-continued

| | Parts by weight |
|---|---|
| water | 115 |

After firing, the preform had a density of 0.55 g/ml and the volume fraction of alumina fibers was 0.17.

EXAMPLE 22

| | Parts by weight |
|---|---|
| chopped alumina fibers | 100 |
| polyvinylalcohol | 20 |
| cellulose pulp | 25 |
| silica sol | 17 |
| water | 53 |

After firing, the preform had a density of 1.0 g/ml and the volume fraction of alumina fibers was 0.3.

EXAMPLE 23

Circular samples of diameter 100 mm were cut from a mat of aligned alumina fibers and assembled in a circular vacuum-infiltratior mould (diameter 100 mm) with the fibers in all the layers being aligned in the same general direction. The thickness of the fiber assembly was built up to a level at which compression to 15 mm thickness would yield a preform cf density 1.2 g/ml. The assembly was then infiltrated with a dilute solution of silica sol (1030W silica sol) containing 30% by weight silica to achieve a pick-up of 5% by weight of silica based on the weight of the fibers. The silica was precipitated onto the fibers by passing through the assembly firstly a 2.5% starch solution and secondly a 0.5% solution of a floculating agent (Percol 292). The assembly was then compressed to a thickness of 15 mm in a press and allowed to dry overnight at about 110° C. to yield a silica-bound preform.

A rectangular sample cut from the preform was boxed in an open-ended rectangular box and heated to 750° C. to burn out any organic material. The boxed preform (at 750° C.) was placed in a casting die preheated to 300° C. and squeeze-infiltrated with an aluminium alloy (LMlO containing 10% magnesium) at 820° C. using a pressure of 30 MPa applied by a ram assembly preheated to 350° C. The resulting MMC was demoulded and surplus aluminium was removed by machining. The (boxed) MMC was cut into rectangular bars and its tensile strength and modulus were determined.

For purposes of comparison an MMC was made by the above procedure from a mat of randomly-orientated, short (up to 5 cm) alumina fibers of mean diameter 3 microns. In order to avoid damaging the fibers on compression, the volume fraction of fibers was limited to 20%.

| Results | Ultimate Tensile Strength (MPa) | Modulus (GPa) |
|---|---|---|
| Unreinforced LM10 | 190 | 70 |
| MMC of invention | 442 | 128 |
| MMC of comparison | 270 | 94 |

EXAMPLE 24

Using the extrusion technique described in Example 16, an MMC was made from chopped alumina fibers and a powdered aluminum alloy (Atomised 6061). The volume fraction of the fibers was 20% and the MMC was subjected to a T6 treatment.

For purpose of comparison, an MMC containing 20% volume fraction fibers was made by hot-pressing a mixture of chopped alumina fibers and powdered alloy (Atomised 6061). The MMC in which the fibers were randomly orientated, was subjected to a T6 treatment.

| Results | Ultimate Tensile Strength (MPa) | Modulus (GPa) |
|---|---|---|
| Unreinforced LM10 | 310 | 70 |
| MMC of invention | 488 | >100 |
| MMC of comparison | 370 | 92 |

We claim:

1. A metal matrix composite comprising a metal matrix material in which is embedded a reinforcing fibrous product said fibrous product comprising a plurality of essentially aligned inorganic oxide fibers of mean diameter below 5 microns wherein a degree of non-alignment of some of the fibers provides for fiber intertwining conferring lateral cohesion on said product.

2. A metal matrix composite as claimed in claim 1 wherein the lateral cohesion in the reinforcing fibrous product is such that the product exhibits a tensile strength of at least 25,000 Pa in a direction perpendicular to the general direction of fiber alignment.

3. A metal matrix composite as claimed in claim 1 wherein the inorganic oxide fibers are alumina fibers having an apparent density of from 1.75 to 3.3 g/ml.

4. The composite as claimed in claim 1 wherein at least 90% of the inorganic oxide fibers are essentially parallel in the general direction of alignment of the fibers.

5. The composite as claimed in claim 1 wherein a proportion of the inorganic oxide fibers do not extend the entire length of the fibrous product.

6. The composite as claimed in claim 1 wherein the volume fraction of fibers is from 10% to 60%.

7. The composite as claimed in claim 3 wherein the fibers have a tensile strength greater than 1500 MPa and a modulus greater than 150 GPa.

8. The composite as claimed in claim 1 wherein the matrix metal is aluminum or an alloy of aluminum.

9. The composite as claimed in claim 1 wherein the matrix metal is magnesium or an alloy of magnesium.

10. The composite as claimed in claim 9 comprising a matrix metal of density less than 2 g/ml having embedded therein alumina fibers of apparent density 2 g/ml or less, the composite having an optical density of less than 2 g/ml.

* * * * *